US006945577B1

(12) United States Patent
Scott

(10) Patent No.: US 6,945,577 B1
(45) Date of Patent: Sep. 20, 2005

(54) RAIN GUTTER CLEANING TOOL

(76) Inventor: Lester Jean Scott, 2272 Highland Park La., Campbell, CA (US) 95008

( * ) Notice: Subject to any disclaimer, the term of this patent is extended or adjusted under 35 U.S.C. 154(b) by 96 days.

(21) Appl. No.: 10/367,304

(22) Filed: Feb. 14, 2003

Related U.S. Application Data

(60) Provisional application No. 60/424,449, filed on Nov. 7, 2002.

(51) Int. Cl.[7] ..... E04D 13/076
(52) U.S. Cl. ..... 294/19.1; 15/236.04
(58) Field of Search ..... 294/19.1, 49, 55; 15/236.04; 172/375, 371, 381

(56) References Cited

U.S. PATENT DOCUMENTS 767,648 A * 8/1904 Korjibsky ..... 126/242
2,083,918 A * 6/1937 Napolis et al. ..... 172/375
2,280,778 A * 4/1942 Andersen ..... 172/371
3,116,796 A * 1/1964 Miljan ..... 172/371
3,858,267 A * 1/1975 Swannie ..... 15/236.04
4,304,498 A * 12/1981 George ..... 401/9
4,542,553 A * 9/1985 Cary ..... 15/236.04
4,549,611 A * 10/1985 Mills ..... 173/375
4,726,090 A * 2/1988 Kilpatrick ..... 15/236.04
5,033,156 A * 7/1991 Stewart ..... 15/236.05
D335,558 S * 5/1993 Boothe ..... D32/49
5,799,996 A * 9/1998 Fredrickson ..... 294/51
5,898,969 A * 5/1999 Middleton ..... 15/236.04
6,428,067 B1 * 8/2002 Barragan ..... 294/19.1
6,526,619 B1 * 3/2003 Cassels, Jr. ..... 15/236.04

* cited by examiner

*Primary Examiner*—Dean J. Kramer
(74) *Attorney, Agent, or Firm*—John J. Leavitt

(57) ABSTRACT

The present invention is a uniquely designed gutter cleaning tool with no moving parts. Designed to move debris from elevated rain gutters by pulling it to an operator stationed on a ladder, to be scooped out and placed into a container. The preferred configuration conforms to the bottom of both K-style and half round gutters and includes a neck with an acme screw throat, protruding from a rectangular, two edged blade, positioned from the neck at an oblique angle. The head, when attached to an extension handle has a cleaning range of fourteen feet left and fourteen feet right for a total of twenty-eight feet from a set station.

5 Claims, 2 Drawing Sheets

RAIN GUTTER CLEANING TOOL

I claim the benefit of a provisional application 60/424,449, dated Nov. 7, 2002.

BACKGROUND OF THE INVENTION

1. Field of the Invention

This invention is a tool for cleaning debris from elevated rain gutters while stationed on a ladder and more particularly a tool that is reversible for drawing along the inside of a gutter of whatever configuration to eliminate debris collected in the gutter.

2. Description of the Prior Art

Rain gutters come in several designs and materials, generally listed under the headings of K-type or half-round. In general, debris and dirt collecting in rain gutters must be cleaned out to avoid water back up that could damage a home or building.

There are numerous cleaning devices, some with handles to be manipulated, blindly, by a person standing on the ground. Some of these devices are described in U.S. Pat. Nos. 5,288,188; 3,858,267; 3,626,542; 6,139,077; 5,988,715 and 5,435,612. These devices disclosed by these patents feature various types of heads designed as scoops, claws, tines, jaws and blades to be used as pushers, scoops or pullers. Some are equipped with a water hose attachment to flush out the debris. Most have limited flexibility in and around gutter spikes and are expensive to manufacture and market. They have several complicated rigid parts and are somewhat awkward and limited in movement.

A few devices, such as U.S. Pat. Nos. 4,848,818 and 4,726,090, require an operator to walk along the roof edge and are therefore accident-prone. ladder, where it is then scooped out of the gutter and into a container (not shown) which may be conveniently suspended on the ladder. This procedure eliminates the necessity of cleaning debris from the ground and surrounding bushes.

For A better understanding of the invention, reference is made to the detailed description following the brief description of the drawings.

DETAILED DESCRIPTION OF THE INVENTION

Figure 3:
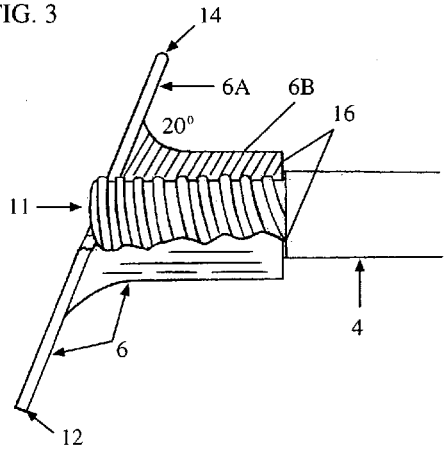
FIG. 3 is a side elevational view shown partly in vertical cross-section to illustrate the detachable inter-engagement of the tool head and a handle.
Figure 4:
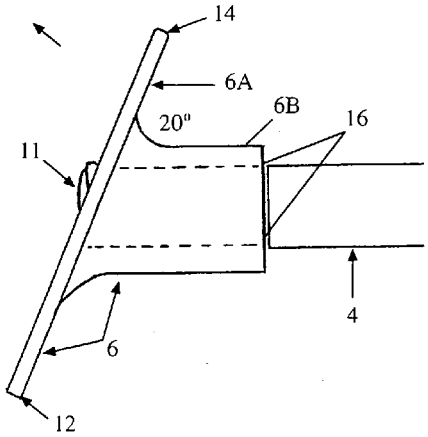
FIG. 4 is a side elevational view of the tool head.

Referring to FIG. 3, the vertical cross-sectional view of the uniquely designed tool head 6 is shown to be cast or formed of metal with no moving parts, removably attached to an extension pole 4 having an acme screw head 11, which protrudes through and threadably detachably engages the internally threaded neck portion 6B with the blade 6A of the tool head 6 that is integrally formed from metal. The side elevational view of the tool head shown in FIG. 4 depicts an extension pole 4 with an acme screw head 11 engaging the internal threads of neck portion 6B and protruding through the blade 6A of the head 6 with the blade 6A positioned at an angle of 20° to the axis of the neck portion 6B.

Figure 5:
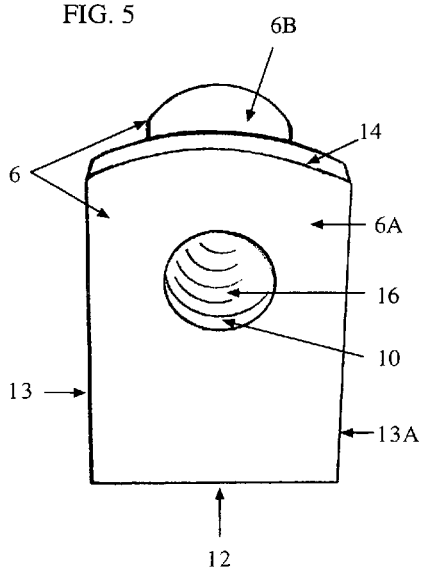
FIG. 5 is a front end perspective view of the tool head apart from a handle.

FIG. 5 is a frontal generally downwardly directed perspective view of the tool head 6 depicting the blade 6A with a generally rectangular lower portion having a flat bottom edge 12 and a top curved or arcuate edge 14 and with both side edges 13 and 13A being perpendicular to the flat bottom edge 12 and with the blade 6A provided with a circular orifice 10 in line with the internally threaded throat 16 of the neck 6B the axis of which is inclined at 20° to the plane of the flat blade plate 6A.

Figure 1:
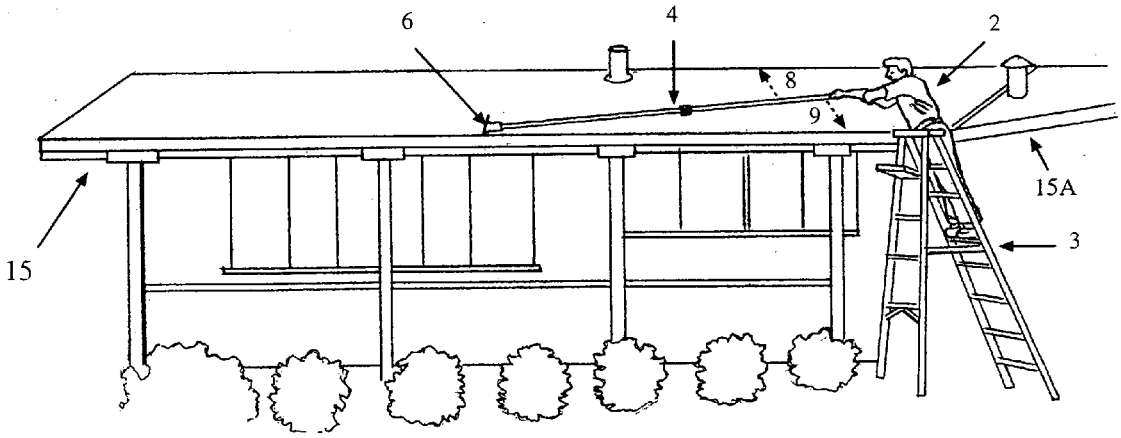
FIG. 1 is a perspective view of the tool head attached to a extended by an operator into an elevated rain gutter mounted on an L-shaped house.

Referring now to FIG. 1 a frontal perspective view of an L-shaped house and roof provided with a K-style gutter 15 with an operator 2 stationed on an eight foot step ladder 3 using an extension pole 4 equipped with a cleaning tool head 6 extending out into the rain gutter 15. It will be apparent that the operator, from one position of the ladder, can reach in opposite directions to clean up to 28' of gutter, moving all of the debris to adjacent the ladder where the debris may be scooped into a container (not shown). Raising or lowering the pole 4 as indicated by arrows 8 and 9, guides the tool head 6 over or under the gutter spikes (not shown) as the operator on the step ladder 3 scrapes the debris to where he is stationed. The operator 2 then removes the debris with a scoop and places it into a container for disposal. Operator 2, by turning to his left, can then clean gutter 15A without moving from his station, giving the operator a cleaning range of fourteen feet in each direction for a total of 28 feet from the ladder.

Figure 2A:
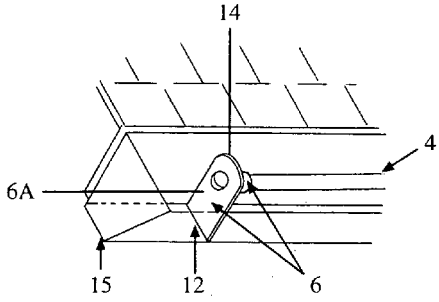
FIG. 2A is a perspective view of the tool head extended inside a K-style gutter.
Figure 2B:
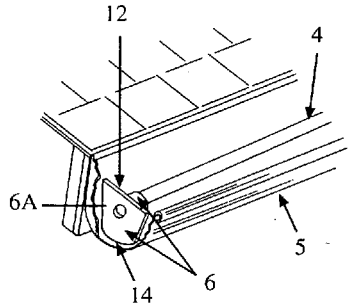
FIG. 2B is a perspective view of the tool head of FIG. 2A shown upside down, in a half round gutter.

Perspective views 2A and 2B are of the K-style gutter 15 and a half round gutter 5. FIG. 2A shows the tool head 6 with the bottom edge 12 of the blade 6A flush against the bottom of a K-style gutter 15 and positioned perpendicular to the plane of the building's roof. FIG. 2B shows the tool head 6 turned upside down from its orientation as shown in FIG. 2A, with the blade's arcuate or curved edge 14 now flush against the bottom of a half round gutter 5 and positioned so that the plane of blade 6A is perpendicular to the plane of the building's roof. The tool head in it's preferred configuration can be operated upside down, sideways, forward and backward while moving heavy compacted or light debris without spreading the debris on the ground and shrubbery.

It is to be understood that the preferred known embodiment of the present invention described herein and depicted in the accompanying drawings is for exemplary purposes and limited only by the essential or characteristic quality of the design and the spirit of the appended claims.

What is claimed is:

1. A rain gutter cleaning tool, comprising:

a) a tool head including a flat blade portion defined by opposed flat surface areas and parallel side edges interrupted at one end of the blade portion by an arcuate end edge and interrupted at the opposite end of the blade by an end edge perpendicular to said parallel side edges;

b) a neck portion having opposed ends one of which is integrally formed on one of said opposed flat surface areas of said blade portion at a location thereon spaced from said side and end edges, said neck portion projecting therefrom at an angle of about 20° to terminate at its opposite end spaced from said one of said opposed flat surfaces with which said neck portion is integrally formed and coincident with a plane angularly disposed to said flat surface area, and;

c) a continuous series of threads formed on said neck portion.

2. The rain gutter cleaning tool according to claim 1, wherein said tool head is formed from metal.

3. The rain gutter cleaning tool according to claim 2, wherein said flat blade portion having opposed flat surface areas is provided with an orifice spaced from said side and end edges and said neck portion is provided with an axially aligned throat formed in said neck portion that extends through said orifice in the flat blade portion and said threads on said neck portion are formed interiorly of said throat.

4. The rain gutter cleaning tool according to claim 3, wherein an elongated extension handle having threads on one end portion thereof is detachably secured to said threads formed interiorly of the throat formed in said neck portion.

5. The rain gutter cleaning tool according to claim 1, wherein an elongated extension handle having threads on one end portion thereof is detachably secured to threads formed on said neck portion.

* * * * *